US010807837B2

(12) United States Patent
Beer

(10) Patent No.: US 10,807,837 B2
(45) Date of Patent: Oct. 20, 2020

(54) TRANSPORT UNIT

(71) Applicant: Hans Kunz GmbH, Hard (AT)

(72) Inventor: Roman Beer, Au (AT)

(73) Assignee: Hans Künz GmbH, Hard (AT)

( * ) Notice: Subject to any disclaimer, the term of this patent is extended or adjusted under 35 U.S.C. 154(b) by 239 days.

(21) Appl. No.: 15/552,824

(22) PCT Filed: Mar. 11, 2016

(86) PCT No.: PCT/AT2016/000026
§ 371 (c)(1),
(2) Date: Aug. 23, 2017

(87) PCT Pub. No.: WO2016/161470
PCT Pub. Date: Oct. 13, 2016

(65) Prior Publication Data

US 2018/0029849 A1 Feb. 1, 2018

(30) Foreign Application Priority Data

Apr. 8, 2015 (AT) ..... A 211/2015

(51) Int. Cl.
*B66C 13/08* (2006.01)
*B66C 13/06* (2006.01)

(52) U.S. Cl.
CPC ..... *B66C 13/08* (2013.01); *B66C 13/06* (2013.01)

(58) Field of Classification Search
CPC ..... B66C 13/04; B66C 13/06; B66C 13/08
See application file for complete search history.

(56) References Cited

U.S. PATENT DOCUMENTS 3,743,107 A * 7/1973 Verschoof ..... B66C 13/06 212/274
3,842,986 A * 10/1974 Hupkes ..... B66C 13/06 212/330

(Continued)

FOREIGN PATENT DOCUMENTS

CN 102838038 12/2012
DE 2316947 12/1973

(Continued)

OTHER PUBLICATIONS

Translation of DE20013621 U1, espacenet.com (Year: 2019).*

(Continued)

*Primary Examiner* — Sang K Kim
*Assistant Examiner* — Nathaniel L Adams
(74) *Attorney, Agent, or Firm* — Volpe and Koenig, P.C.

(57) ABSTRACT

A transport unit (1) for transporting at least one container (31) or another load, wherein the transport unit (1) has at least one trolley (2) and at least one load suspension device (3) and at least eight lifting cables (20-27), and the load suspension device (3) has connecting means (14) for fastening the container (31) or the other load and is suspended on the trolley (2) such that it can be lifted and lowered by the lifting cables (20-27), wherein the lifting cables (20-27) can be wound up on cable drums (4) which are rotatably mounted on the trolley (2), wherein each lifting cable (20-27) can be wound up and/or is wound up at least in part on a separate cable drum (4), and the rotational speed and/or the direction of rotation for all the cable drums (4) can each be set individually.

15 Claims, 4 Drawing Sheets

(56) References Cited

U.S. PATENT DOCUMENTS

| | | | |
|---|---|---|---|
| 5,765,703 | A | 6/1998 | Shiwaku |
| 5,769,250 | A | 6/1998 | Jussila et al. |
| 6,991,064 | B2 | 1/2006 | Ehrenleitner |
| 7,284,744 | B1 * | 10/2007 | Lerchenmueller ..... B66C 13/06 254/278 |
| 2007/0158290 | A1 | 7/2007 | Lerchenmueller et al. |
| 2008/0121601 | A1 * | 5/2008 | Ehrenleitner ..... B66C 1/20 212/76 |

FOREIGN PATENT DOCUMENTS

| | | |
|---|---|---|
| DE | 141817 | 5/1980 |
| DE | 20013621 | 1/2001 |
| DE | 102004040663 | 3/2006 |
| DE | 202006000490 | 6/2006 |
| JP | S62200694 | 12/1987 |
| JP | H0449195 | 2/1992 |
| SU | 701916 | 12/1979 |

OTHER PUBLICATIONS

Three photographs showing a presentation of a transport unit of a competitor company, admitted prior art, date unknown, Jan. 1, 2015.
"Custom Multi-Axis Positioning Material Handling System", four pages, retrieved on Mar. 3, 2015, www.mhs-llc.com/custom-multi-axis-positioning-material-handling-system.
Page 268 of "China Press Machine" and translation, Sep. 30, 2013.
Wan, et al., "Hydraulic and Pneumatic Transmission", National Defense Industry Press, pp. 212-213, Mar. 31, 2008.

* cited by examiner

TRANSPORT UNIT

BACKGROUND

The present invention relates to a transport unit for transporting at least one container or another load, wherein the transport unit has at least one trolley and at least one load suspension device and at least eight lifting cables, and the load suspension device has connecting means for fastening the container or the other load and is suspended on the trolley such that it can be lifted and lowered by the lifting cables, wherein the lifting cables can be wound up on cable drums which are mounted rotatably on the trolley. In addition, the invention also relates to methods for transporting at least one container or another load, and to a crane with at least one transport unit.

For the transport of containers by at least one crane, use is made of transport units of the above mentioned type. In addition to the lifting and lowering, i.e. a movement in the vertical direction, an adjustment of containers for other loads in at least one horizontal direction is generally also necessary in order to deposit the containers or the load at a predetermined place, to transfer same onto tracks, to stack same on one another, etc. The trolley, also called a crane trolley, generally runs here along a main girder of a crane and permits the movement of the transport unit in a first horizontal direction, while the crane as a whole is generally displaceable in a second horizontal direction on crane rails. Rough positioning of the transport unit or of the load suspension device with respect to the container or the other load is therefore also possible.

For rapid handling of the containers, in addition to high movement speeds, rapid and also highly precise position ability (=fine positioning) of the load suspension device especially also at the container suspension site and at the intended container depositing site is also advantageous.

DE 20 2006 000 490 U1 presents a transport unit of the type mentioned at the beginning, in which the load suspension device is supported by in each case two longitudinal pairs of cables and in each case two transverse pairs of cables. The two transverse pairs of cables are jointly driven by a motor. The two longitudinal pairs of cables are also driven by a common motor. For the fine positioning of the load suspension device, piston-cylinder units are provided in the region of the anchoring points of the pairs of cables on the load suspension device, said piston-cylinder units permitting displacement of the load suspension device in relation to the cable engagement points of the pairs of cables. In order to activate the piston-cylinder units, corresponding hydraulic assemblies, electric components, sensors, etc. are necessary on the load suspension device, and increase that weight of the load suspension device.

SUMMARY

It is the object of the invention to provide a transport unit of the above mentioned type, in which the dead weight of the load suspension device can be reduced in comparison to the prior art.

This is achieved with a transport unit with one or more features of the invention.

In the case of a transport unit according to the invention, it is therefore provided, in other words, that each lifting cable can be wound up and/or is at least partially wound up on a separate cable drum, and all of the cable drums are drivable independently of one another at different rotational speeds and/or in different directions of rotation.

The basic concept of the present invention provides that, for the winding up and unwinding of its lifting cable, each cable drum can be driven individually with a rotational speed and/or direction of rotation desired at the particular moment in order to influence the entire movement of the load suspension device or of the container. The rotational speed could also be referred to as speed of rotation. With the transport unit according to the invention, it is possible to undertake a fine positioning of the load suspension device (this also referred to as a head block) hanging on the trolley by individual winding up and unwinding of each individual lifting cable. The overall movements of the load suspension device then arises through the interaction of the cable drums or lifting cables which are each individually activatable. It is possible to dispense with additional drive units, for example the piston-cylinder units known from the prior art, for the fine positioning of the load suspension device, and the energy supply and activation means thereof. This results in a significantly reduced weight of the load suspension device.

In order to realize an exclusive lifting and lowering movement of the loads suspension device in the vertical direction, it is conveniently provided that the cable drums can be driven synchronously, i.e. that the cable drums can then be driven at the same time with a corresponding, optionally same, rotational speed or in the same direction of rotation. This can be achieved by a correspondingly individual activation of the cable drums with specified values correspondingly coordinated with one another.

A cable drum within the context of the invention could also be referred to as a cable winch and serves for winding up and unwinding a lifting cable. By rotation of the cable drum, a lifting cable or an end portion of the lifting cable is wound up or unwound. The number of cable drums therefore corresponds to the number of lifting cables.

In this document, the lifting cable referred to is a cable which contributes to lifting the container or another load and runs continuously between the end windup on the respective cable drum and an end of the lifting cable that faces away from the cable drum and is anchored to a component. The term of cable or lifting cable also includes straps or chains in addition to a cable per se. The entirety of the lifting cables forms what is referred to as the cable shaft (also called cable tower) which extends between the trolley and the load suspension device. The cable shaft is that supporting structure which supports the load suspension device and the containers or the other load optionally fastened thereto. The geometry of the cable shaft is dependent on the relative position of the load suspension device with respect to the trolley.

In the event of failure of one of the at least eight lifting cables, for example due to a rupture of a lifting cable, the transport unit can still be safely operated with the remaining lifting cables without the stability of the cable shaft and the safety of the transport unit being substantially reduced.

It is preferably provided that the load suspension device has two mutually opposite longitudinal sides and two mutually opposite end sides oriented normally to the longitudinal sides, wherein at least two of the lifting cables act on each of the end sides and longitudinal sides, and in each case the lifting cables which act on the same end side form at least one intersection, as seen in a direction parallel to the longitudinal sides, and/or in that in each case the lifting cables which act on the same longitudinal side form at least one intersection, as seen in a direction parallel to the end sides.

By the intersecting arrangement of in each case two lifting cables which act on the same longitudinal or end side of the load suspension device, the stability of the cable shaft and of the transport unit respectively can be increased. Although a lifting cable can substantially only absorb forces in the direction of the course of the lifting cable, with the crossed arrangement mentioned of in each case two lifting cables, oscillating movements of the load suspension device due to dynamic processes (acceleration processes, wind, etc.) can be avoided.

It is conveniently provided that at least one of the lifting cables, preferably each lifting cable, is deflected at the load suspension device by a deflection pulley, and that the end of the lifting cable which faces away from the cable drum is anchored on the trolley. By the deflection of the lifting cable, the effective cable forces in the lifting cable are reduced since a type of block and tackle is realized. The deflection of the cable at the deflection pulley could also be referred to as reeving of the lifting cable or double guidance of the lifting cable. Due to the reduced cable forces, it is possible to select a smaller cable diameter. In addition, a smaller diameter of the cable drums can advantageously also be realized. Due to the lower cable forces, the necessary torques for driving a respective cable drum are also lower. That end of the lifting cable which faces away from the cable drum is advantageously anchored or fixed on the trolley by a cable end connector. Cable end connectors of this type are well known.

It is particularly preferably provided that the transport unit has, preferably for each lifting cable, at least one force measuring device for determining the cable force acting in one of the lifting cables, preferably in the respective lifting cable. The cable force refers to that force with which the lifting cable is pulled, i.e. that force with which the cable is tensioned and which acts in the longitudinal direction of the cable. The cable force is variable and depends on the static boundary conditions (dead weight of the low suspension device, dead weight of the cable, dead weight of the container or of the other load) and the dynamic boundary conditions, such as, for example, the acceleration of the load suspension device at a particular instance, wind forces in action, etc.

The service life of a lifting cable crucially depends on the cable forces which occur. The loading of the respective lifting cable at a particular instance can be determined with reference to the measurement of the cable force by the measuring device. In preferred variant embodiments, the information about the cable force acting in the respective lifting cable can be used for controlling and/or regulating the overall movement of the transport unit or of the load suspension device. An imminent overload of a lifting cable can be immediately determined, for example if the container or the load suspension device collides with other obstacles, and can be prevented by corresponding activation of the cable drums.

It is advantageously provided that each cable drum is driven individually by a dedicated motor, preferably an electric motor. By a "common electric shaft", the individual cable drums can be driven synchronously, as is necessary, for example, when raising the load suspension device in the lifting direction (=vertical). For this purpose, the motors advantageously have sensors, such as, for example, incremental transmitters or resolvers, which detect the angular position of the respective motor shaft. By corresponding activation or regulation, an isogonic rotation of the motor shafts of all of the motors can be realized. The individual motors can also be activated independently of one another, as can be realized particularly advantageously with electric motors.

In an alternative embodiment of the invention, it is also conceivable and possible for at least two cable drums to be driven by a common motor, wherein a correspondingly controllable or regulatable gearing is provided for the individual setting of the rotational speed and direction of rotation of each individual cable drum.

It is preferably provided that the force measuring device for measuring the cable force is arranged on a torque support of a gearing, wherein the gearing acts between the cable drum and the motor. The driving torque or the rotational movements are produced by the motor and are transmitted to the respective cable drum via the gearing. The torque support serves for supporting the gearing housing on the trolley of the crane and prevents rotation of the gearing housing during operation. For this purpose, the torque support generally has a lever which is connected to the trolley, for example, by a bolt. By measurement of the supporting forces of the torque support, said supporting forces being introduced into the supporting structure of the trolley, the effective torques in the drive crane or the cable forces effective in the respective lifting cable can be determined. The force measuring device arranged on the torque support could have, for example, a force measuring bolt or a weighing cell. The use of other force or torque measuring devices which are known per se in the prior art is also conceivable and possible.

In an alternative embodiment of the force measuring device, it can be provided that the force measuring device for detecting the cable force is arranged at an end of the lifting cable that faces away from the cable drum.

The present invention also provides a crane, preferably a gantry crane, with at least one transport unit according to the invention. The trolley of the transport unit is advantageously moveable with running wheels on running rails of a main girder (=crane girder) of the crane.

The invention furthermore provides a method for transporting at least one container or another load by a transport unit according to the invention, wherein a translational and/or rotational movement of at least one container hanging on the load suspension device, or of another load, preferably in six degrees of freedom, takes place exclusively by corresponding winding up and unwinding of the lifting cables of the transport unit on and from the respective cable drum, and the cable drums are correspondingly driven for this purpose.

In addition to translational movements, it is therefore advantageously also possible to undertake rotational movements, especially about an imaginary vertical, but also about an imaginary horizontal, axis of rotation, for the fine positioning of the load suspension device or of the container or the other load. In specialist jargon, said rotational movements are also referred to as skew, trim and list movements. By corresponding coordination of the direction of rotation and/or of the rotational speed of the individual cable drums, all six degrees of freedom of a container can advantageously be achieved exclusively by individual driving of the cable drums. The six degrees of freedom refer to movements in three directions which are independent of one another (=translation) and rotation in three planes which are independent of one another (=rotation).

In a further method according to the invention for transporting a container or another load by a transport unit according to the invention, it is provided that the cable forces of at least one lifting cable, preferably of each lifting cable, are measured in order to avoid an overload, and the cable drums are correspondingly driven individually independently of one another or individually. In particular, it can be provided to drive the individual cable drums with different or else identical angular accelerations and/or rotational speeds and/or torques, depending on requirement.

The cable forces are advantageously determined in a measuring position in which the container or the other load hangs freely. On the basis of the determined cable forces, it is then possible to select a specified value for the maximally permissible angular acceleration and/or a specified value for a maximally permissible rotational speed of the respective cable drum. It can advantageously be provided that the other crane drives for the rough positioning of the container or of the other load can also be limited in respect of the maximum movement speed and/or the maximum acceleration depending on the cable forces actually measured.

In addition or instead, it can be provided, in a further method, that the current cable force of a lifting cable is monitored during the entire movements of the cable or of the other load, and the cable drums are activated depending on the current cable force. It is therefore possible, for example, to detect suddenly occurring dynamic forces and to reduce or to compensate for them by a corresponding reaction in order thereby to avoid an overload in the lifting cable or in the lifting cables.

In a further method according to the invention, it is conceivable and possible to select the position or orientation of a container with respect to the trolley in such a manner that the value of the cable forces of the respective lifting cables can be harmonized with one another. In particular, when containers are not uniformly of the same weight (the center of gravity thereof is located eccentrically), it is thereby possible to distribute the load even better to the different lifting cables, to correspondingly select the moving speed of the crane and to increase the service life of the lifting cables.

Of course, the various methods mentioned above can also be combined with one another.

BRIEF DESCRIPTION OF THE DRAWINGS

Further features and details of preferred embodiments of the invention are explained with reference to the exemplary embodiment, which is illustrated in the figures, of a transport unit according to the invention and of a crane according to the invention. In the figures.

DETAILED DESCRIPTION OF THE PREFERRED EMBODIMENTS

Figure 1:
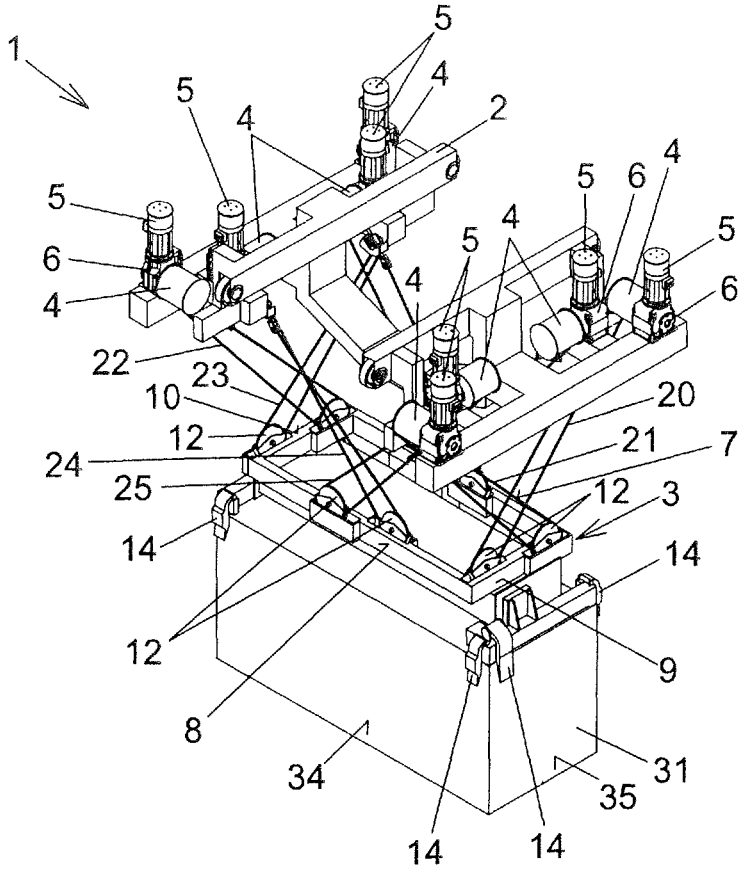
FIG. 1 shows an isometric view of a transport unit according to the invention.

For better clarity, not all of the components in all of the figures are provide with a reference sign.

The transport unit 1 has a trolley 2 and a load suspension device 3. The load suspension device 3 serves for fastening a container 31 and, for this purpose, has a plurality of connectors 14 which are known per se. These connectors 14 are also called "flippers". The load suspension device 3 hangs on the trolley 2 by eight lifting cables 20-27 and can be moved relative to the trolley 2 by extension or shortening of the free length of the respective lifting cable 20-27.

The lifting cables 20-27 can be wound up or are wound up individually on cable drums 4 which are mounted rotatably on the trolley 2. The number of cable drums 4 therefore corresponds to the number of lifting cables 20-27. All of the cable drums 4 are drivable individually or independently of one another with different or identical rotational speed and/or in different or identical directions of rotation. In the exemplary embodiment, each of the cable drums 4 is driven by a dedicated motor 5. It is advantageously provided that at least two of the cable drums 4 have axis of rotation 17 which are oriented parallel to one another. In the exemplary embodiment, the axis of rotation 17 of in each case 4 of the cable drums 4 are oriented parallel to one another.

In the exemplary embodiment, the motors 5 are designed as electric motors and are each combined with a gearing 6. Combinations of this type are also referred to as geared motors. The motors 5 are activatable independently of one another, that is to say the different motors 5 can have different or identical rotational speeds and/or different or identical directions of rotation at the same time. It is also possible to subject the cable drums 4 to different torques generated by the respective motor 5.

In the exemplary embodiment, each of the lifting cables 20-27 is deflected at the load suspension device 3 by a deflection pulley 12. That end of each lifting cable 20-27 which faces away from the cable drum 4 is anchored on the trolley 2 by a cable end connection 16. Those cable portions of a lifting cable 20-27 which are deflected at the deflection pulley 12 run substantially in the same direction between the deflection pulley 12 and the trolley 2. The term "substantially" in this context means an angular deviation of the deflected cable portions of at most 30°, preferably of less than 20°.

By the double guidance of each lifting cable 20-27 (=reeving), the cable forces acting in a respective lifting cable 20-27 are halved in comparison to single guidance, and therefore the diameter of the lifting cables 20-27 can be selected to be smaller. The torques necessary for rotating the cable drums 4 are also lower, as a result of which smaller motors 5 and gearing 6 can be used. It is thereby also possible to select cable drums 4 with a smaller diameter.

The load suspension device 3 has a substantially rectangular contour, as seen in plan view, i.e. it has two mutually opposite longitudinal sides 7, 8 and mutually opposite end sides 9, 10 oriented normally to the longitudinal sides 7, 8. The longitudinal sides 7, 8 and the end sides 9, 10 are advantageously oriented parallel to the longitudinal sides 34 and the end sides 35 of the container 31 fastened to the load suspension device 3. In the exemplary embodiment, in each case two deflection pulleys 12 are arranged on the longitudinal sides 7, 8 and end sides 9, 10 and are mounted rotatably in relation to the load suspension device 3. In each case two of the lifting cables 20-27 act on each of the end sides 9, 10 and longitudinal sides 7, 8 via the respective deflection pulleys 12.

Figure 3:
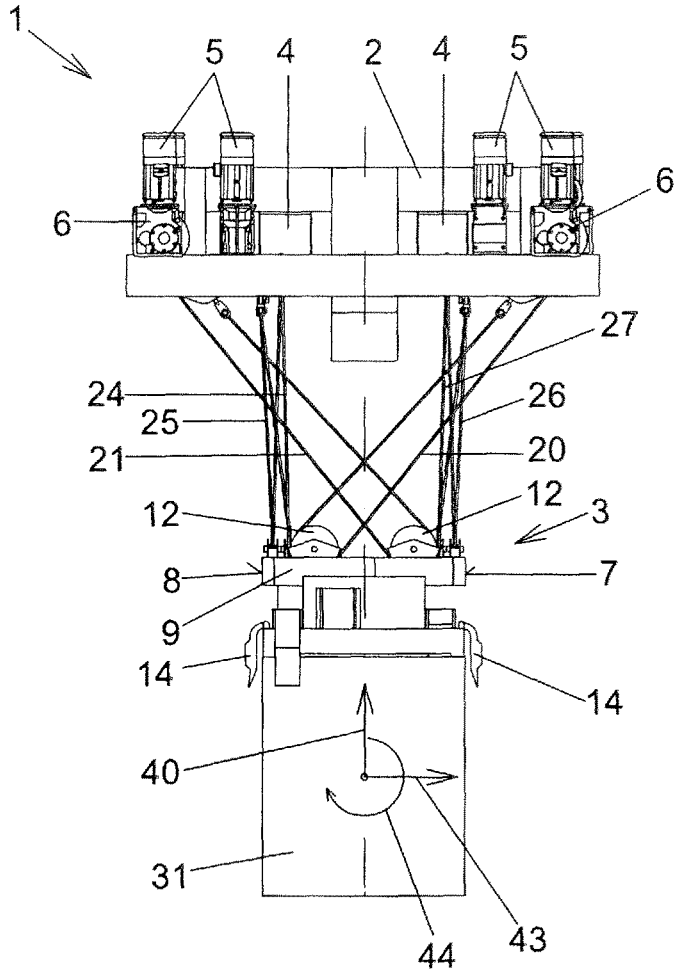
FIG. 3 shows the transport unit according to FIG. 1, as seen in a view of the end side of the container.

In the exemplary embodiment, the lifting cables 20, 21 or 20, 23 acting on the same end side 9, 10 form four intersections 11, as seen in a direction parallel to the longitudinal sides 7, 8, cf. FIG. 3. The lifting cables 24, 25 or 26, 27 which act on the same longitudinal side 7, 8 also form four intersections 11, as seen in a direction parallel to the end sides 9, 10. High stability of the cable shaft, which is formed by the lifting cables 20-27, of the transport unit 1 can be achieved by the intersection of the lifting cables 20-27 acting in each case on the same longitudinal side 7, 8 or end side 9, 10. Since cables can primarily transmit forces in the longitudinal direction of the cables, this intertwined arrangement of the lifting cables 20-27 is advantageous. In addition, it is possible to move with the transport unit 1 along relatively narrow container aisles, cf. FIG. 8. If the deflection pulleys 12 are dispensed with and each lifting cable 20-27 is only guided individually, instead of four in each case only one intersection arises for two intersecting lifting cables.

For lifting and lowering the container 31 or the load suspension device 3 in the vertical direction, the cable drums 4 are driven synchronously by the motors 5, optionally apart from the fine adjustment which is possible according to the invention. Tilting of the container 31 or of the load suspension device 3 during the lifting and lowering movement is therefore prevented. The rotational speed of a respective motor 5 is detected by corresponding sensors and harmonized with the other motors 5. This synchronized operation of several independent motors 5 is also referred to as "common electric shaft".

In addition to the synchronous operation of the cable drums 4, a driving of the cable drums 4 independently of one another is also possible according to the invention, and therefore, apart from or during the lifting and lowering movement, fine positioning of the load suspension device 3 in further degrees of freedom is also permitted.

Figure 2:
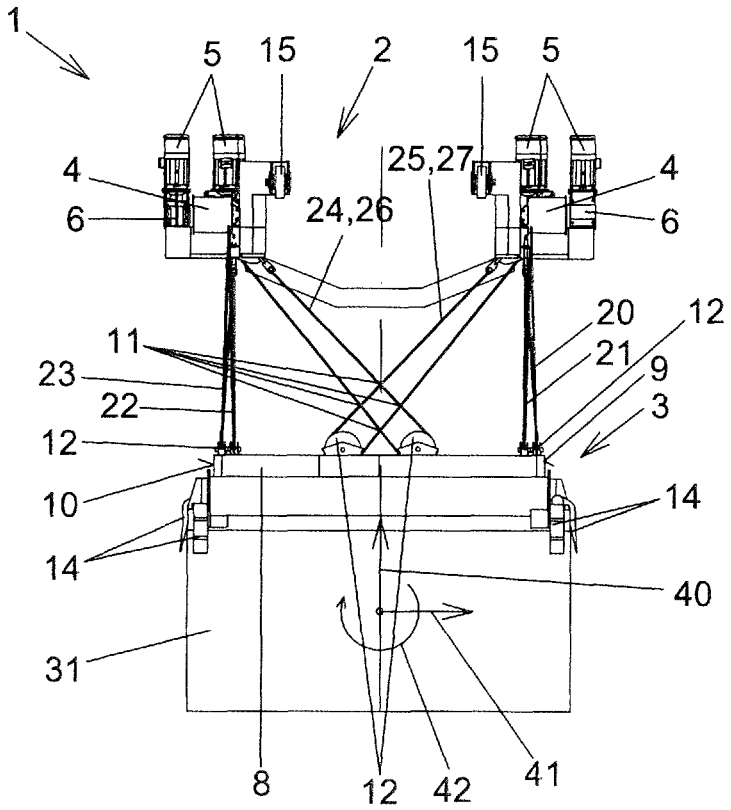
FIG. 2 shows the transport unit according to FIG. 1, as seen in a view of the longitudinal side of the container.

Possible directions of movement of the load suspension device 3 are shown in FIG. 2 based on a view of the longitudinal side 34 of the container 31. For a movement of the load suspension device 3 or of the container 31 in the first direction 40 (=lifting direction), all of the cable drums 4, as already explained, are activated at least substantially synchronously, and the respective lifting cables 20-27 are wound up substantially synchronously on the respective cable drums 4.

For the movement in the second direction 41, the cable drums 4 are driven individually. While a longitudinal portion of a respective lifting cable 24, 26 is unwound from the corresponding cable drums 4 and a longitudinal portion of the respective lifting cable 25, 27 is wound up on the corresponding cable drum 4, the load suspension device 3 or the container 31 moves in the second direction 41. The lifting cables 20 to 23 are correspondingly wound up or unwound proportionally in order to avoid an overload or sagging of the individual lifting cables.

In addition to the purely translational movements in the first direction 40 and the second direction 41, each combination of said directions is conceivable and possible. Of course, the load suspension device 3 can also be moved in the corresponding opposite direction to the first direction 40 and to the second direction 41. The directions of rotation of the cable drums 4 are then correspondingly reversed.

In addition, it is provided in the exemplary embodiment that the load suspension device 3 or the container 31 can be pivoted in a pivoting direction 42 (=rotational movement). By a corresponding coordination of the movements of the cable drums 4, this movement can be achieved in the pivoting direction 42. The lifting cables 20, 21 are partially unwound from the respective cable drum 4, while the lifting cables 22, 23 are partially would up onto the corresponding cable drum 4. The lifting cables 22, 26 and 25, 27 are correspondingly wound up or unwound in order to carry out the lifting movement without loosening or overloading the corresponding lifting cables. A pivoting movement in the opposite direction to the pivoting direction 42 is likewise possible. The pivoting movement in or counter to the pivoting direction 42 can also be combined in any way with the translational movement in the first direction 40 and the second direction 41.

Analogously, as has been explained with reference to FIG. 2 for the view of the longitudinal side 34 of the container 31, a movement possibility of the load suspension device 3 with respect to the view of the end side 35 of the container 31 or a view of the end side 9 of the load suspension device 3 can also be realized, cf. FIG. 3. Translational movements or counter to the first direction 40 and/or counter to the third direction 43 and a pivoting movement in or counter to the pivoting direction 44 (=rotational movement) about an axis of the container 31 or of the load suspension device 3 are also possible by targeted driving of the respective cable drums 4 of the lifting cables 20-27.

Figure 4:
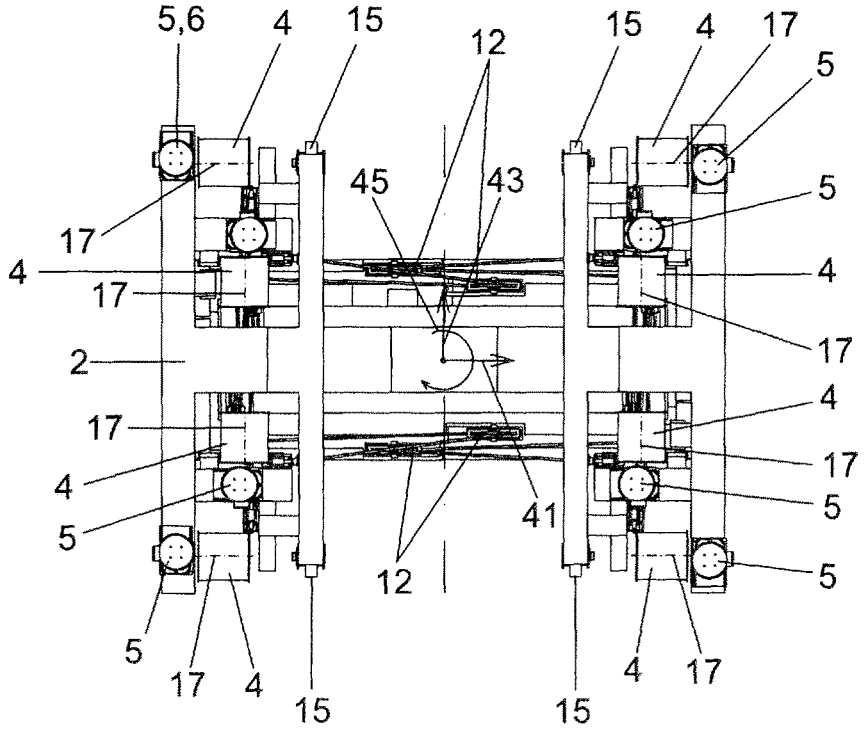
FIG. 4 shows the transport unit according to FIG. 1 in a top view.
Figure 5:
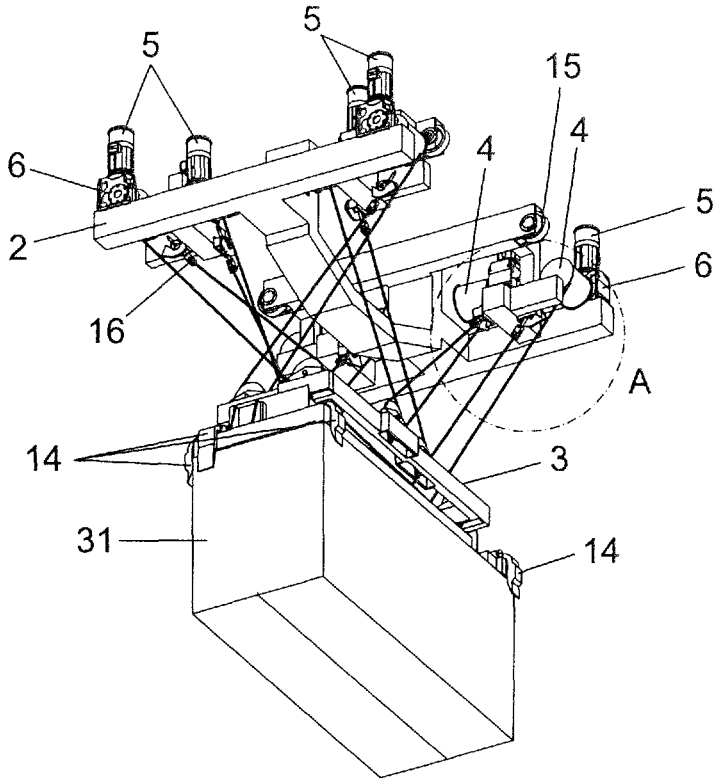
FIG. 5 shows an isometric view of the transport unit according to FIG. 1, as seen from below.

Pivoting of the load suspension device 3 about the vertical axis of the transport unit 1, in or counter to the pivoting direction 45, can correspondingly also be realized, cf. FIG. 4.

Advantageously, the load suspension device or the container 31 can thus be moved as desired in six degrees of freedom, as is also provided in the exemplary embodiment. Since the fine positioning of the load suspension device 3 can be undertaken with the lifting cables 20-27, an intermediate frame and the additional drives known in the prior art for the fine positioning can be dispensed with. It is therefore overall advantageously possible to save up to a third of the mass of the load suspension device 3 in comparison to the load suspension device known from the prior art.

Figure 6:
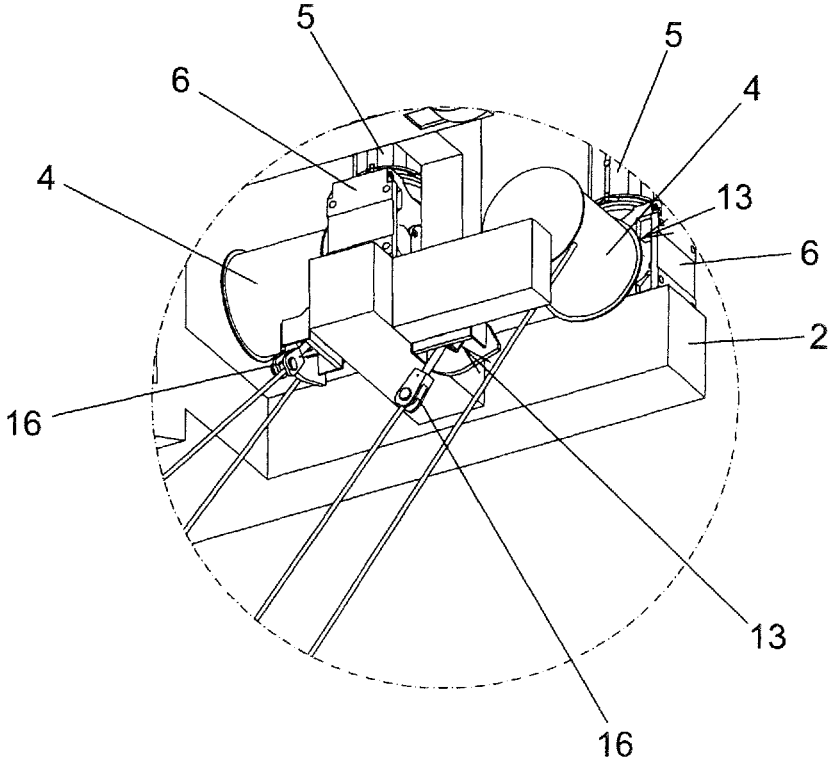
FIG. 6 shows the detail A according to FIG. 5.

In the exemplary embodiment, the cable force acting in the respective lifting cable 20-27 is measured by a respective measuring device 13. The measuring device 13 is in each case arranged on a torque support of the gearing 6 of the geared motor. The gearing 6 acts between the respective cable drum 4 and the respective motor 5. In FIG. 6, the torque support of the gearing 6 is concealed by the cable drum 4. The torque support serves for supporting the housing of the gearing 6 or the geared motor on the trolley 2. The occurring differential torques of drive side and output side of the gearing 6 are introduced into the supporting structure of the trolley 2 via the torque support and therefore rotation of the gearing 6 during operation is prevented. By the arrangement of a force measuring bolt of the measuring device 13 on the torque support, between torque support and trolley 2, the current forces or torques can be determined and therefore a conclusion can be drawn about the cable forces specifically effective in the lifting cables 20-27. Measuring devices 13 of this type are well known. In other embodiments, the measuring device 13 could also have a weighting cell arranged on the torque support or a pressure measuring sensor which permits a conclusion to be drawn regarding the differential torques or the effective cable forces.

Alternatively or additionally, it is also possible for a respective measuring device 13 for detecting the cable force to be arranged at an end of the respective lifting cable 20-27 that faces away from the cable drum 4. A measuring device 13 of this type could be arranged in the region of the cable end connector 16, cf. FIG. 6, as is provided in the exemplary embodiment.

The effective cable forces in the lifting cables 20-27 can be determined in a measuring position of the transport unit 1, in which the load suspension device 3 hangs freely. In the event of asymmetrical loads, i.e. in particular when containers 31 are not loaded uniformly, very different cable forces can occur in the lifting cables 20-27. In order to avoid overloading of individual lifting cables 20-27 during transport of the container 31, the maximum acceleration of the container and/or the maximum movement speed are advantageously limited depending on the cable forces measured in the measuring position. By use of the cable drums 4 which are driven independently of one another, it is also possible to harmonize the cable forces effective in the lifting cables 20-27 by the load being correspondingly distributed to the acting lifting cables 20-27 by fine positioning of the load suspension device.

It is also provided in the exemplary embodiment that the load suspension device 3 or the container 31 can be shifted in its orientation by the cable drums 4, which are drivable independently of one another, in order to further equalize the different cable forces in the lifting cables 20-27, in particular when containers 31 are loaded non-uniformly, or to distribute the load between the lifting cables 20-27.

The cable forces in the lifting cables 20-27 are advantageously harmonized during the entire movement of the container 31 or of the load suspension device 3. Dynamically occurring loadings of the individual lifting cables 20-27, for example due to wind forces acting abruptly on the container 31 or on the load suspension device 3, can also be compensated for by harmonizing the cable forces.

By the use of at least eight lifting cables 20-27, it is also possible that, in the event of a cable rupture of one of the lifting cables 20-27, the remaining seven lifting cables receive the load of the container 31 and therefore high reliability of the transport unit 1 is achieved without a significant reduction in the stability of the cable shaft occurring.

Figure 7:
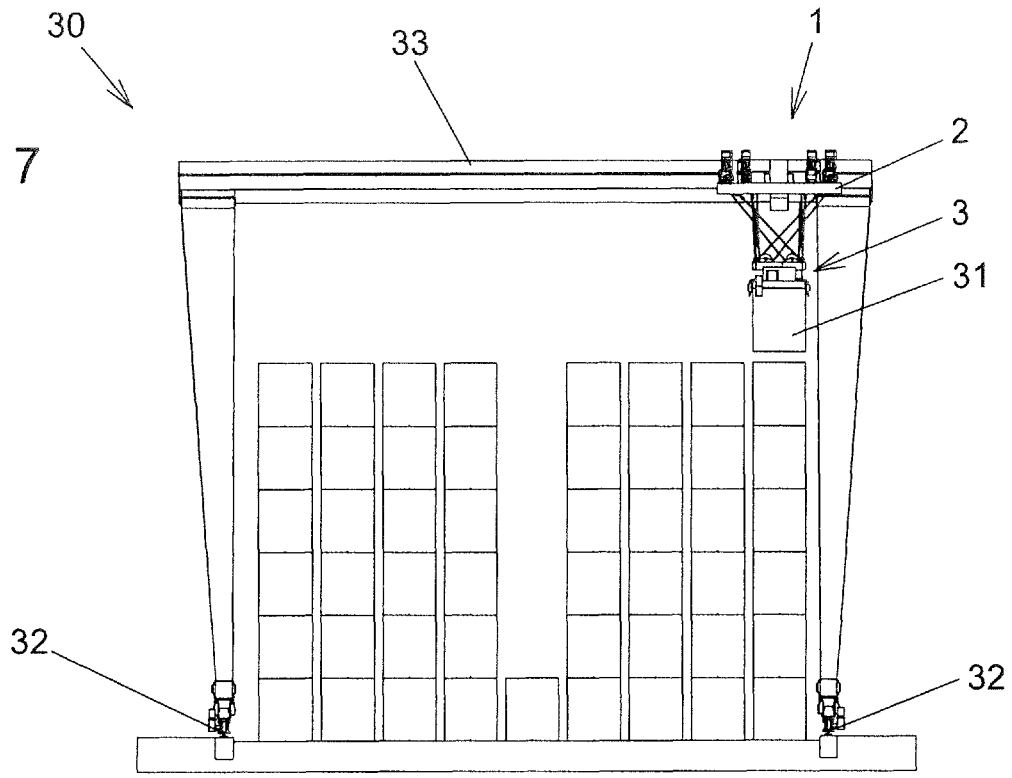
FIG. 7 shows a gantry crane with a transport unit according to the invention with a raised load suspension device.
Figure 8:
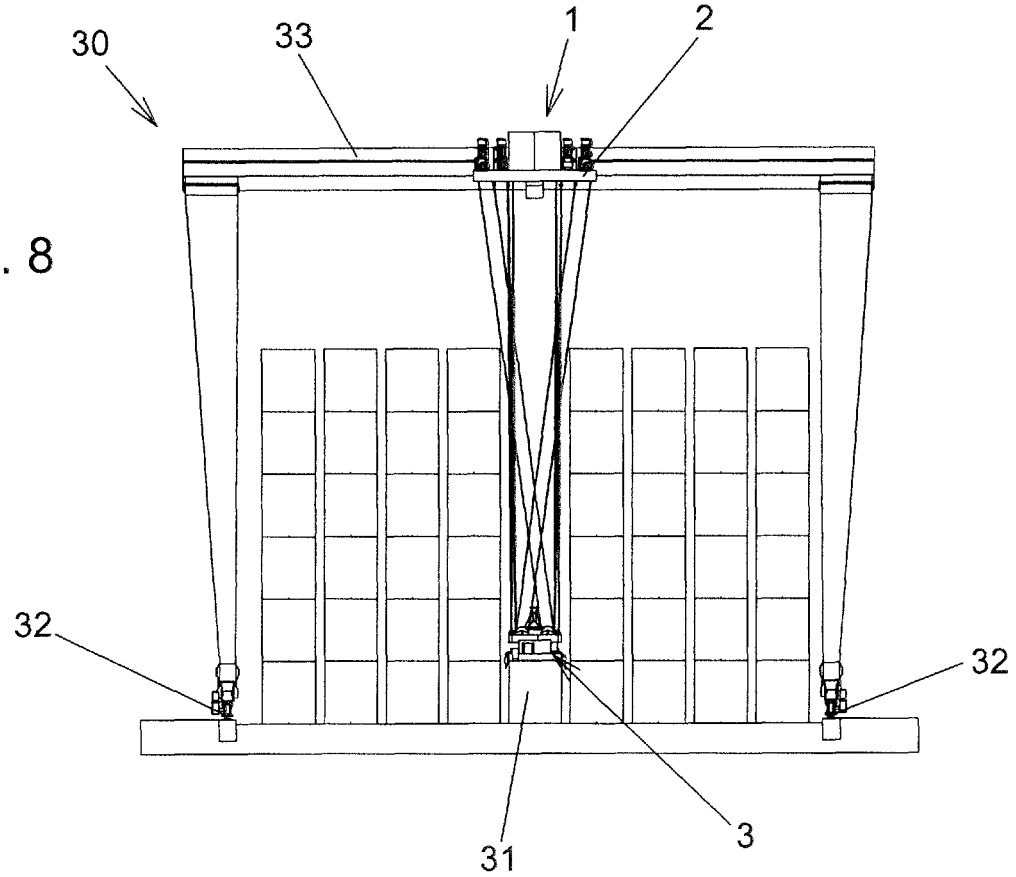
FIG. 8 shows the gantry crane according to FIG. 7 with a lowered load suspension device.

In the exemplary embodiment according to FIGS. 7 and 8, the transport unit 1 is used at a crane 30 configured as a gantry crane. The trolley 2 of the transport unit 1 is movable along a main girder 33 of the crane 30. For this purpose, the trolley 2 has running wheels 15 which roll along running rails (not illustrated specifically) of the main girder 33. The entire crane 30 is movable on crane rails 32 in the longitudinal direction of the crane rails 32. The movement in the direction of the crane rails 32 and along the main girder 33 serves for the rough positioning of the transport unit 1.

In the exemplary embodiment, it is provided that a respective lifting cable is deflected at a deflection pulley 12. It is also conceivable and possible for a respective lifting cable to be fixedly anchored on the load suspension device 3 by a cable and connection. Even when the lifting cables are anchored on the load suspension device, the lifting cables acting on the same longitudinal or end side of the load suspension device advantageously intersect, wherein the lifting cables acting on the same longitudinal or end side form a single intersection.

In certain exemplary embodiments, the load suspension device 3 could additionally have a pivoting unit in order to permit pivoting of the container about greater angles, such as, for example, 90° or more.

In contrast to the exemplary embodiment shown, it is conceivable and possible for in each case at least two cable drums to be driven by a common motor. The cable drums could then be driven individually in different directions of rotation and/or with different rotational speeds via a variable distribution gearing.

The transport unit according to the invention can also be adapted for other loads. It is not limited to the transport of containers.

In other variant embodiments, the transport unit 1 could also be used on an overhead crane or on another crane.

KEY TO THE REFERENCE NUMBERS

1 transport unit 22 lifting cable
2 trolley 23 lifting cable
3 load suspension device 24 lifting cable
4 cable drum 25 lifting cable
5 motor 26 lifting cable
6 gearing 27 lifting cable
7 longitudinal side 30 crane
8 longitudinal side 31 container
9 end side 32 crane rail
10 end side 33 main girder
11 intersection 34 longitudinal side
12 deflection pulley 35 end side
13 measuring device 40 first direction
14 connector 41 second direction
15 running wheel 42 pivoting direction
16 cable end connection 43 third direction
17 axis of rotation 44 pivoting direction
20 lifting cable 45 pivoting direction
21 lifting cable

The invention claimed is:

1. A transport unit for transporting at least one container or another load, the transport unit comprising at least one trolley, at least eight lifting cables, a connector that hangs on the trolley by the at least eight lifting cables, the connector is adapted to connect to the container or the other load and is suspended on the trolley such that the container or load is liftable and lowerable by the lifting cables, the lifting cables are windable on cable drums that are mounted rotatably on the trolley, each said lifting cable is at least one of wound up or is at least partially wound up on a separate one of the cable drums, and at least one of a rotational speed or a direction of rotation for each of the cable drums is independently settable.

2. The transport unit as claimed in claim 1, wherein the connector has two mutually opposite longitudinal sides and two mutually opposite end sides oriented normally to the longitudinal sides, at least two of the lifting cables act on each of the end sides and at least two of the lifting cables act on each of the longitudinal sides, and at least one of the following conditions is met: (a) in each case the lifting cables which act on a same one of the end sides form at least one intersection, as seen in a direction parallel to the longitudinal sides, or (b) in each case the lifting cables which act on a same one of the longitudinal sides form at least one intersection, as seen in a direction parallel to the end sides.

3. The transport unit as claimed in claim 1, further comprising a deflection pulley on the connector, and wherein at least one of the lifting cables is deflected at the deflection pulley, and an end of the lifting cable which faces away from the cable drum is anchored on the trolley.

4. The transport unit as claimed in claim 1, further comprising a force sensor that determines a cable force acting in one of the lifting cables.

5. The transport unit as claimed in claim 4, wherein each said cable drum is driven individually by a dedicated motor.

6. A crane comprising at least one transport unit as claimed in claim 1.

7. The transport unit as claimed in claim 4, wherein the force sensor is arranged on a torque support of a gearing that acts between the cable drum and the motor.

8. The transport unit as claimed in claim 4, wherein the force sensor that detects the cable force is arranged at an end of the lifting cable that faces away from the cable drum.

9. A method for transporting at least one container or another load, the method comprising providing the transport unit as claimed in claim 4, measuring the cable forces of at least one said lifting cable in order to avoid an overload, and correspondingly driving the cable drums individually independently of one another.

10. The method of claim 9, wherein the measuring of the cable forces is carried out for each said lifting cable.

11. A method for transporting at least one container or another load, the method comprising providing the transport unit as claimed in claim 1, carrying out at least one of a translational or rotational movement of at least one container or another load hanging on the connector exclusively by corresponding winding up and unwinding of the lifting cables of the transport unit on and from the respective cable drum, and correspondingly driving the cable drums for this purpose.

12. The method of claim 11, wherein the at least one of the translational or the rotational movement is carried out with six degrees of freedom of movement.

13. The transport unit as claimed in claim 5, wherein each of the dedicated motors is an electric motor.

14. The transport unit as claimed in claim 11, wherein each on the lifting cables is deflected at the connector by a respective deflection pulley.

15. The transport unit as claimed in claim 1, further comprising at least force sensor that determines a cable force acting in each of the lifting cables.

* * * * *